United States Patent [19]

Diard et al.

[11] Patent Number: 4,957,304

[45] Date of Patent: Sep. 18, 1990

[54] SKI COMPRISING A LONGITUDINAL RIB AT ITS TOP PART

[75] Inventors: Jean-Luc Diard; Philippe Grandjacques; Gilles Recher, all of Annecy, France

[73] Assignee: Salomon S.A., Annecy, France

[21] Appl. No.: 275,131

[22] PCT Filed: Feb. 4, 1988

[86] PCT No.: PCT/FR88/00061

§ 371 Date: Oct. 5, 1988

§ 102(e) Date: Oct. 5, 1988

[87] PCT Pub. No.: WO88/05676

PCT Pub. Date: Aug. 11, 1988

[51] Int. Cl.[5] ..... A63C 5/04

[52] U.S. Cl. ..... 280/609; 280/610; 280/615

[58] Field of Search ..... 280/609, 610, 607, 615, 280/636

[56] References Cited

U.S. PATENT DOCUMENTS

| | | | |
|---|---|---|---|
| 3,762,734 | 10/1973 | Vogel | 280/610 |
| 4,714,267 | 12/1987 | Abondance et al. | 280/610 |

FOREIGN PATENT DOCUMENTS

| | | | |
|---|---|---|---|
| 254748 | 6/1967 | Australia | 280/610 |
| 167462 | 1/1986 | European Pat. Off. . | |
| 193519 | 9/1986 | European Pat. Off. . | |
| 2826884 | 12/1979 | Fed. Rep. of Germany . | |
| 3518457 | 12/1985 | Fed. Rep. of Germany | 280/615 |
| 1282053 | 12/1961 | France . | |
| 84816 | 3/1965 | France . | |
| 92020 | 8/1968 | France . | |
| 2097849 | 3/1972 | France . | |
| 2522976 | 9/1983 | France . | |
| 152918 | 6/1932 | Switzerland . | |

*Primary Examiner*—David M. Mitchell

*Attorney, Agent, or Firm*—Sandler, Greenblum & Bernstein

[57] ABSTRACT

The ski comprises at its top part a longitudinal rib usable particularly for the lateral guiding of a shoe. In order to improve the technical qualities of the ski without substantially increasing its weight, the cross-section of the rib is comprised at least in the front part of the central area (A) where the shoe sole is bearing, of the superposition of at least two elementary sections (2,3) having each the shape of a quadrilateral and interconnected by a common side forming the lower side of the upper elementary section and the upper side of the lower elementary section of which the lower side is horizontal, the lateral sides (7,8) of the lower elementary section (3) converging upwards and being more inclined with respect to a vertical and longitudinal plane than those (5,6) of the upper elementary section (2).

33 Claims, 4 Drawing Sheets

A
B
C
P
P1
2
3
4
5
6
7
8
9
10

SKI COMPRISING A LONGITUDINAL RIB AT ITS TOP PART

The present invention relates to a ski comprising a longitudinal rib at its top part.

Skis, particularly cross-country skis, are already known which comprise a longitudinal rib on their top face. This longitudinal rib generally presents a trapezoidal transverse section, in other words, it is defined by a horizontal top face and two inclined lateral faces, and this rib of trapezoidal cross section joins the lower part of the ski which presents a rectangular transverse section, of small height, of which the small sides constitute the edges of the ski. Due to the reduced height of these edges, such a ski slides more easily over the snow. Furthermore, in the case of a cross-country ski, the top longitudinal rib may serve in particular for laterally guiding the shoe mounted on the cross-country ski, which shoe is adapted to that end thanks to the provision, in its sole, of a groove presenting in cross section a shape complementary of that of the rib of the ski.

The present invention relates to improvements in such a ski for the purpose of improving its technical qualities, without notably increasing its weight.

To that end, this ski comprising a longitudinal rib at its top part is characterized in that the cross section of the rib is comprised, at least in the front part of the central area where the shoe sole is bearing, of the superposition of at least two upper and lower elementary sections each having the shape of a quadrilateral and interconnected by a common side forming the lower side of the upper elementary section and the upper side of the lower elementary section of which the lower side is horizontal, the lateral sides of the lower elementary section converging upwards and being more inclined, with respect to a vertical and longitudinal plane, than the lateral sides of the upper elementary section.

Various embodiments of the present invention will be described hereinafter, by way of non-limiting examples, with reference to the accompanying drawing, in which.

Figure 1:
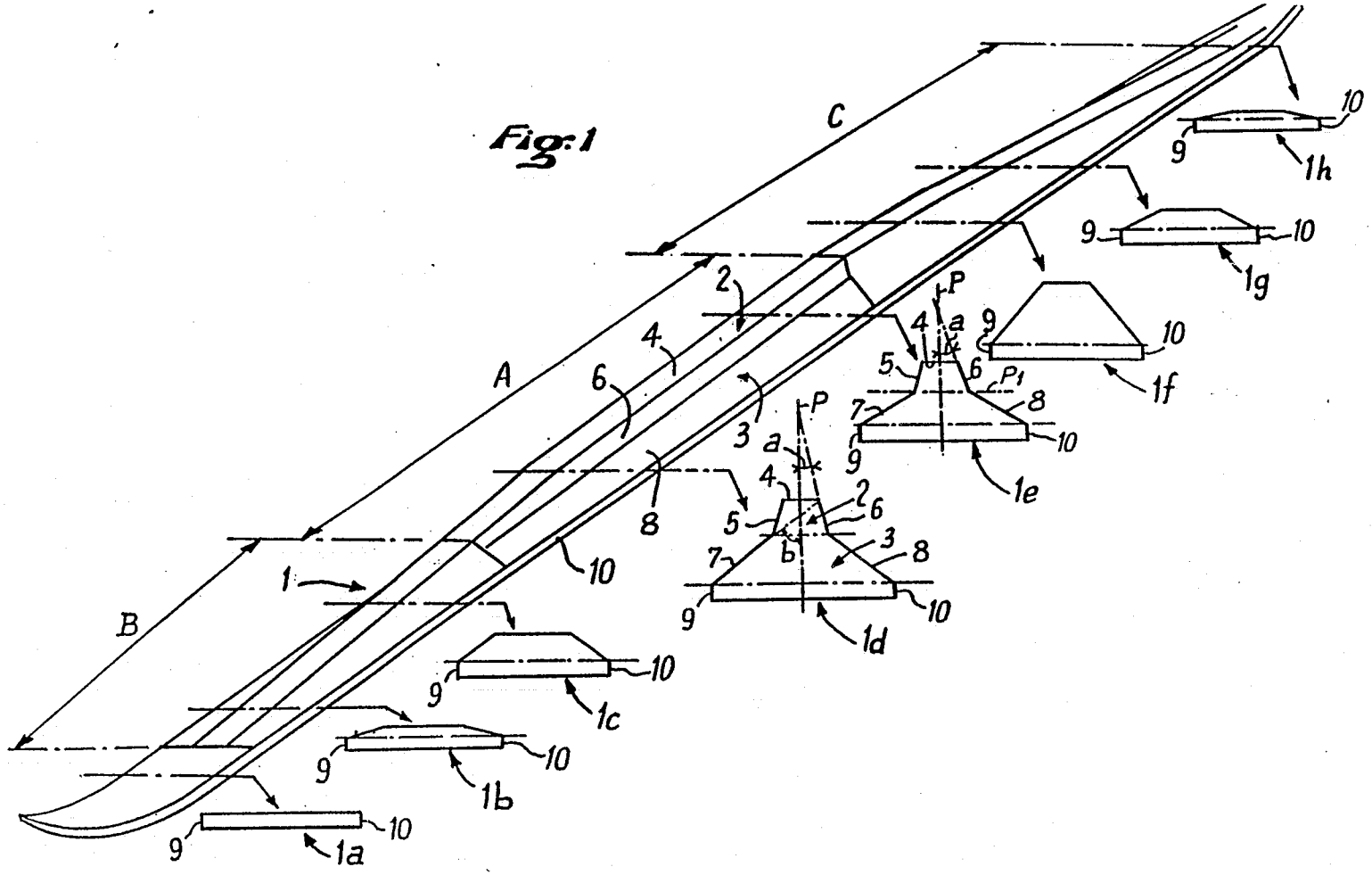
FIG. 1 is a view in perspective of a cross-country ski with longitudinal rib, with illustrations of the transverse section of the ski at different points of its length.

FIG. 1 shows a cross-country ski 1 which has a transverse section with profile evolutive in the longitudinal direction and which presents, at its top part, over the greater part of its length, a longitudinal rib. The transverse section of this rib, located above the edges of the ski, is constituted, over certain parts of the length of the ski, by one sole quadrilateral, in the present case an isosceles trapezium, and, over another part of the length, by two superposed quadrilaterals, in the present case two isosceles trapeziums. More particularly, the cross-country ski 1 may be subdivided into three longitudinal areas where the longitudinal rib is formed, namely a central area A where a cross-country ski shoe (not shown) bears which is connected to the ski at its front end and of which the sole is provided with a longitudinal groove, and two front and rear longitudinal areas B and C which extend the central bearing area A respectively forwards and rearwards, and which join flat front and rear end parts, i.e. bereft of the longitudinal rib. In the front and rear areas B and C, the transverse section of the rib of the cross-country ski 1 has the shape of a single isosceles trapezium, whilst, in the central longitudinal area A, its transverse section is constituted by the superposition of two elementary sections of which each has the shape of an isosceles trapezium.

FIG. 1 shows various profiles of the cross section of the cross-country ski 1 over its length. In its front end part, the transverse section of the ski 1 has a flattened rectangular form 1*a* defined laterally by the two vertical edges 9, 10 of the ski and which is found all along the ski. The transverse section of the rib, considered as limited to the part located above the lower rectangular part defined by the edges 9, 10 and which is absent in the front end part, presents, in the front longitudinal area B, the shape of a single isosceles trapezium, whose height increases rearwardly, as represented by the two profiles 1*b* of small height and 1*c* of height greater than the preceding one. In the transverse plane of join between the front area B and central area A, the transverse section of the rib 1 passes from the shape of a single isosceles trapezium to that of two superposed isosceles trapeziums, as represented by profiles 1*d* and 1*e*. The transverse section of the rib then resumes again the shape of a single isosceles trapezium in the rear section C, as illustrated by profiles 1*f*, 1*g*, as far as the rear end part of the ski where the rib is absent and the cross section of the ski has a flattened rectangular shape similar to that of the front end part.

In the central bearing area A whose length is in fact substantially equal to or slightly greater than that of the shoe, the transverse section of the rib of the cross-country ski 1 comprises an upper elementary section 2, defining a longitudinal guiding rib proper, and a lower elementary section or base 3, these two elementary sections each having, in that case, the shape of an isosceles trapezium. The upper guiding rib 2 presents a horizontal top face or edge 4 which is extended downwardly by two inclined lateral faces 5, 6. The three faces 4, 5, 6 define the upper rib 2 which contributes to the lateral guiding and centering of the shoe on the ski, further to the engagement of this guiding rib 2 in the longitudinal groove of the sole of the shoe, when cross-country skiing is practised.

The inclination of the lateral faces 5, 6 of the upper guiding rib 2, with respect to the vertical and longitudinal plane of symmetry P of the ski, preferably varies from front to rear of the central bearing area A. In front of this central bearing area A, i.e. where the front end of the shoe is fixed, the angle a formed by the inclined lateral faces 5, 6 with the vertical plane P varies from 0 to 10 degrees and it is preferably close to 5 degrees, whilst, in the rear part of the central bearing area A, where the heel of the shoe is applied, this angle is greater and it may vary from 20 to 40 degrees.

The lower trapezoidal elementary section or base 3 comprises two inclined lateral faces 7, 8 extending downwardly the inclined lateral faces 5, 6 are symmetrical with respect to the vertical plane P. The upper guiding rib 2 and the lower base 3, both in the form of isosceles trapezium, therefore have a common base, in the horizontal plane of join P1 between the inclined lateral faces 5, 6 on the one hand and 7, 8 on the other hand, which constitutes the large base of the upper trapezoidal rib 2 and the small base of the lower base 3.

The inclined lateral faces 7, 8 of the base 3 are more inclined, with respect to the vertical and longitudinal plane P, than the upper inclined faces 5, 6, the angle of inclination b of these faces 7, 8 with respect to plane P being able to vary from 30 to 60 degrees. The two lower inclined lateral faces 7, 8 of the base 3 join the vertical edges 9, 10, of small height, of the ski.

FIGS. 2 to 20 illustrate, by way of non-limiting examples, various embodiments of the cross-country ski according to the invention. In these various embodiments, the cross-country ski is made by assembling, by gluing, several profiles preferably made of a composite material of the glass-epoxy resin type.

Figure 2:
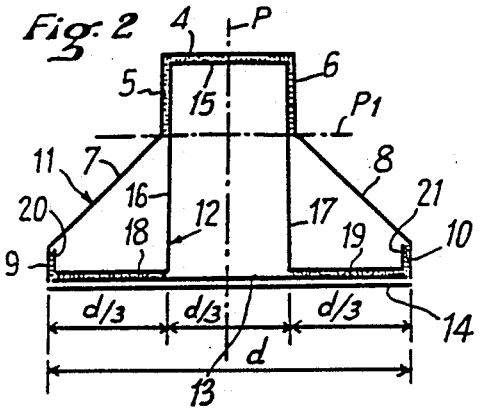
FIGS. 2 to 20 are views in vertical and transverse section, on a larger scale, of various embodiments of the ski according to the invention.
Figure 3:
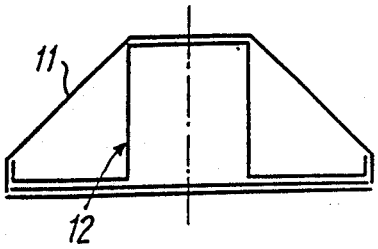
Figure 4:
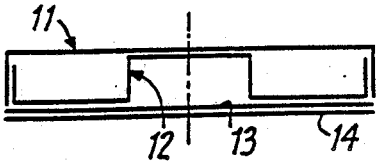

In the embodiment shown in FIGS. 2 to 4, the cross-country ski is obtained by assembling two profiles, namely an outer profile 11 or "shell", of which the evolutive transverse section defines the profile of the ski over the whole of its length, as set forth with respect to FIG. 1, and an inner profile 12 or "core" which conserves the same transverse section shape over the whole length of the ski, but whose height is variable. The ski also comprises a lower horizontal reinforcing element 13 which is glued beneath the core 12 and beneath this reinforcing element 13 is, in turn, glued the actual sole 14 of the ski. FIGS. 2 to 4 show various profiles of the shell 11 corresponding to that of the various transverse sections of the ski. In FIG. 2 which shows a transverse section of the ski in the central bearing area A. The outer shell 11 consequently has a transverse section constituted by the two superposed isosceles trapeziums and it comprises the upper horizontal face or edge 4, the upper faces 5, 6 slightly inclined with respect to the vertical and longitudinal plane of symmetry P, and the lower lateral faces 7, 8 more inclined with respect to the vertical plane P and which extend downwardly by the vertical edges 9, 10 of the ski. The inner core 12 itself has a transverse section of omega shape and it comprises an upper horizontal wall 15, located beneath the edge 4 and glued thereto, two lateral walls 16, 17, vertical or slightly inclined with respect to the vertical and longitudinal plane P, forming a rectangle or a central isosceles trapezium, and two horizontal lower flanges 18, extending outwardly respectively from the lower ends of the vertical faces 16, 17 and beneath which is glued the reinforcing element 13. These horizontal flanges 18, 19 may terminate in raised edges 20, 21 bent square upwardly, parallel to the edges 9, 10 and glued thereinside.

The distance between the lateral and vertical faces 16, 17, at their lower ends where they join the flanges 18, 19, is preferably equal to one third the width d of the ski, each of the flanges 18, 19 consequently also having a width equal to one third the width of the ski d/3. The advantage of such a distribution is to make it possible to obtain an efficient support of the upper guiding rib, constituted by faces 4, 5, 6, to reinforce "on penetration" the inner element or core 12, to reinforce the edges of the ski and to perform the functions of shear of a ski core whilst procuring a hollow and light structure, having an excellent resistance/weight ratio. Furthermore, since the core 12 supports the edge 4 for guiding the shoe and follows the shape thereof, this core 12 directly transmits, by its lower part constituted by the horizontal flanges 18, 19, the efforts exerted by the shoe on all the parts of the ski in contact with the snow, i.e. the edges 9, 10.

FIG. 3 shows the shape of the transverse section of the ski in the front area A or rear area B. In this case, the outer shell 11 has a transverse section reduced to one sole isosceles trapezium, whilst the core 12, still in omega form, has a reduced height.

FIG. 4 shows the transverse section of the ski in one of its front or rear end parts. In that case, the outer shell 11 has a flat and horizontal form and it caps the core 12, still in omega form but of very reduced height.

Figure 5:
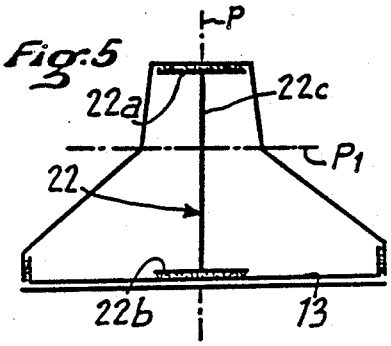
Figure 6:
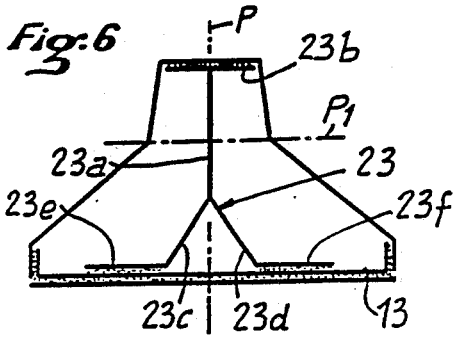
Figure 7:
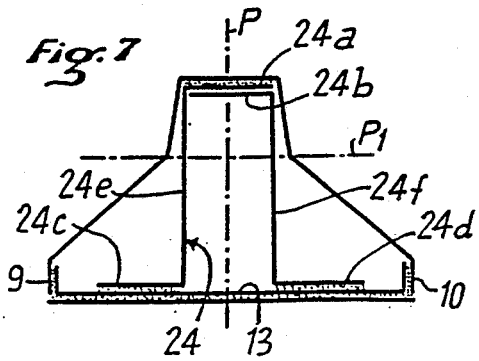

FIGS. 5 to 7 illustrate various variant embodiments of the inner core of the ski.

In the embodiment of the invention shown in FIG. 5, the inner core 22 has a transverse section in the form of an I of which the upper horizontal flange **22*a* and lower horizontal flange 22*b*, connected by a vertical web 22*c*, are respectively glued in abutment beneath the edge 4 and on the central part of the reinforcing element 13**.

In the variant embodiment of the invention shown in FIG. 6, the transverse section of the central core 23 has the form of an upturned Y and this core comprises an upper vertical web **23*a* extending as far as the centre of a horizontal flange 23*b* glued beneath the edge 4, two inclined lower branches 23*c*, 23*d* issuing from the vertical core 23*a* extending downwardly and outwardly and which are joined to respective horizontal flanges 23*e*, 23*f* extending outwardly and glued to the reinforcing element 13**.

In the variant embodiment of the invention shown in FIG. 7, the transverse section of the inner core is in omega form and this core is constituted by two halves substantially symmetrical with respect to plane P, each being substantially in the form of a Z. The upper horizontal flanges **24*a*, 24*b*, extending towards plane P, of these two halves in Z form are superposed and glued to each other, under the edge 4, whilst the lower horizontal flanges 24*c* and 24*d*, extending outwardly, are glued to the reinforcing element 13. Vertical walls 24*e*, 24*f* extend respectively between the horizontal flanges 24*a*, 24*c* on the one hand and 24*b*, 24*d*** on the other hand.

Figure 8:
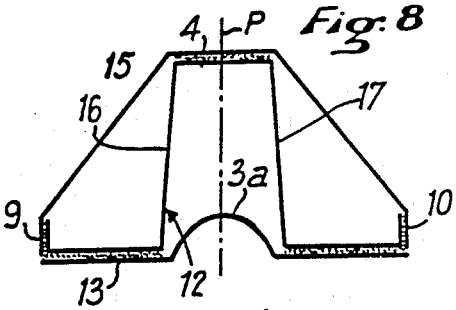

FIG. 8 illustrates a variant embodiment in which the reinforcing element 13 presents, in its central part, a longitudinal rib **13*a* projecting inwardly, this rib 13*a* extending between the lower parts of the two lateral and vertical faces 16, 17 of the omega-shaped core 12**.

Figure 9:
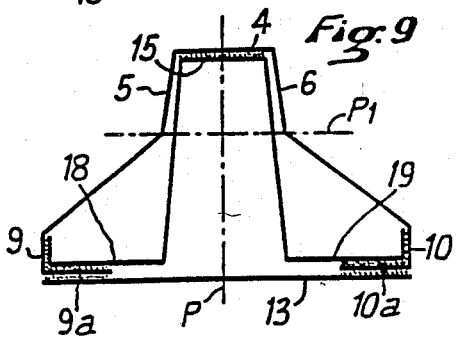

FIG. 9 illustrates an embodiment in which each of the edges 9, 10 is extended inwardly by a respective square raised edge **9*a*, 10*a* maintained between the corresponding flange 18, 19 of the omega-shaped core 12 and the reinforcing element 13**.

Figure 10:
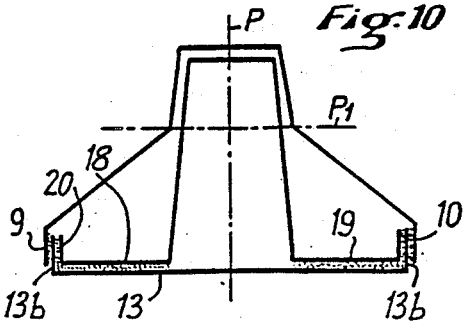

In the variant embodiment of the invention shown in FIG. 10, the reinforcing element 13 is extended, at its ends, by a raised edge **13*b* extending square upwardly and which is maintained glued between the raised edges 20, 21 of the flanges 18, 19 of the omega-shaped core 12 and the edges 9, 10**.

Figure 11:
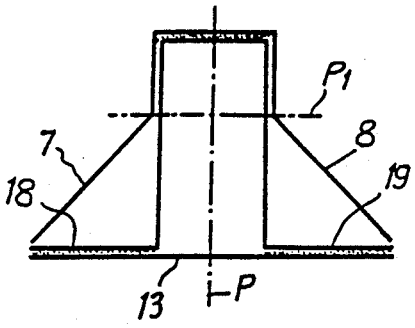

FIG. 11 shows a variant embodiment of a cross-country ski in which the edges 9, 10 virtually no longer exist as such. In other words, in this variant embodiment, the lower inclined lateral faces 7, 8 directly join the ends of the flanges 18, 19 of the core 12 and the ends of the lower reinforcing element 13, assembly being effected, as before, by gluing.

Figure 12:
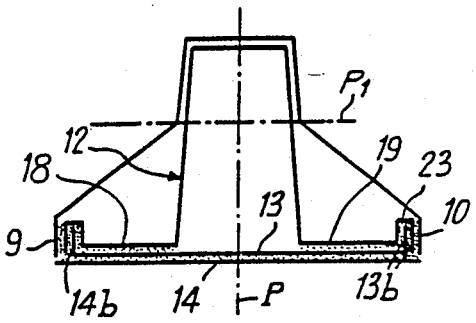

In the variant embodiment of the invention shown in FIG. 12, the lower horizontal flanges 18, 19 of the omega-shaped core 12 terminate in raised edges 22, 23 having in transverse section the form of an upturned or downwardly open U. These U-shaped raised edges 22, 23 respectively cap the square edges **13*b*, extending upwardly, of the reinforcing element 13 and they are glued both to these raised edges 13*b* and to the edges 9, 10** of the ski.

Although in the foregoing description it has been indicated that the transverse section of the rib of the ski, of evolutive profile, was constituted by one sole isosceles trapezium or two superposed isosceles trapeziums, it is possible to make the ski according to the invention with profiles of different quadrilaterals. FIGS. 13 to 17 illustrate, in non-limiting manner, some profiles which may be adopted for the transverse section of the ski, in the central area where the two superposed quadrilaterals are located.

Figure 13:
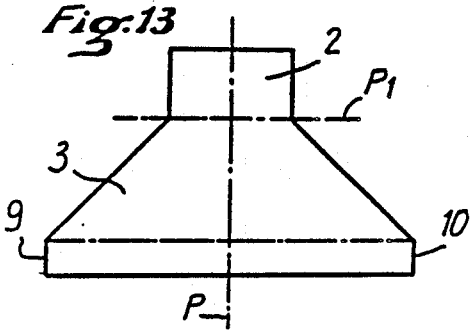

FIG. 13 illustrates a transverse section in which the upper elementary section 2 has a rectangular shape and joins the top small base of a lower elementary section 3 in the form of an isosceles trapezium, the whole then being symmetrical with respect to the vertical and longitudinal plane P.

Figure 14:
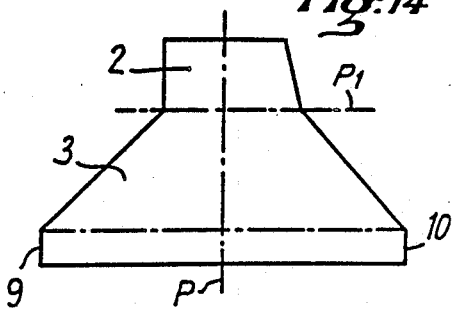

In the variant embodiment of the invention shown in FIG. 14, the upper elementary section 2 has the shape of a right-angled trapezium likewise joined to a lower elementary section 3 in the form of an isosceles trapezium.

Figure 15:
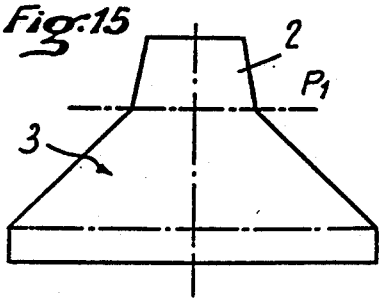

In the variant embodiment of the invention shown in FIG. 15, the upper elementary section 2 has the shape of any trapezium and it joins a lower elementary section 3 in the form of an isosceles trapezium.

Figure 16:
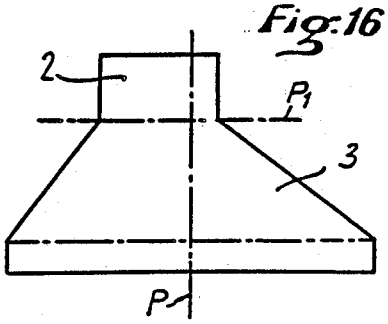
Figure 17:
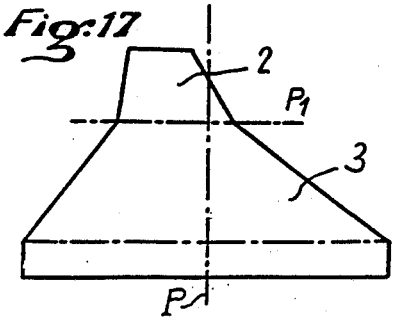
Figure 18:
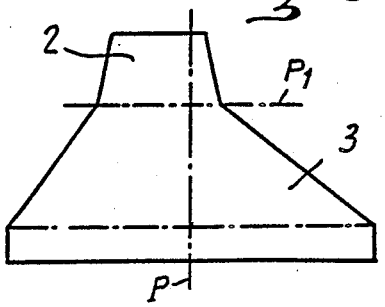

FIGS. 16, 17, 18 illustrate embodiments in which the lower elementary section 3 has the shape of any trapezium, the upper elementary section 2 having the shape of a rectangle or a square (FIG. 16), any trapezium (FIG. 17) or an isosceles trapezium (FIG. 18).

Figures 19, 20, 21:
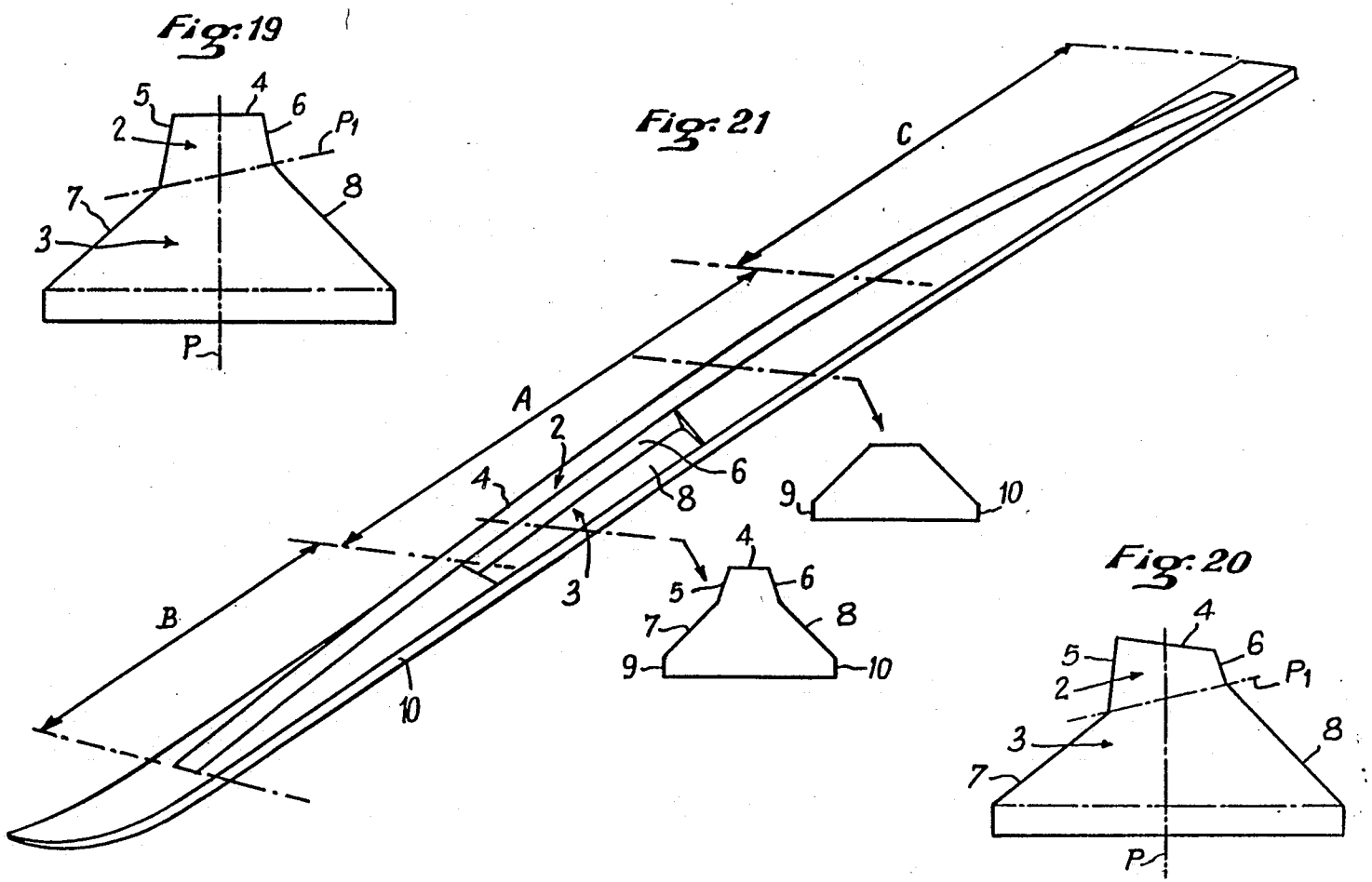
FIG. 21 is a view in perspective of a variant embodiment of the cross-country ski.

FIGS. 19 and 20 illustrate embodiments of the invention in which the two upper and lower elementary sections 2 and 3 are constituted by any quadrilaterals. In that case, the two quadrilaterals constituting the upper and lower elementary sections 2 and 3 join along a common side, indicated in broken lines, and which is contained in a plane of join P1 inclined with respect to the horizontal. There again, the upwardly converging lateral sides 5, 6 of the quadrilaterals constituting the upper elementary section 2 are less inclined, with respect to the vertical and longitudinal plane P, than the upwardly converging lateral sides 7, 8 of the quadrilateral constituting the lower elementary section 3. Furthermore, in the embodiment of the invention shown in FIG. 19, the upper side 4 of the upper elementary section 2 is horizontal, whilst, in the embodiment of the invention shown in FIG. 20, this side is inclined with respect to the horizontal.

FIG. 21 shows a variant embodiment of the ski in which the central bearing area A comprises a front part in which the transverse section of the ski is constituted by two superposed quadrilaterals, in the present case two isosceles trapeziums, whilst its rear part is constituted by one sole quadrilateral, in the present case an isosceles trapezium. In that case, the ski shoe is guided at the front by the upper longitudinal rib engaging in a relatively narrow groove, formed in the front part of the shoe, whilst the heel of this shoe bears on the rear part of the central area A, with transverse section in the form of a single isosceles trapezium. The lower surface of the heel may then be flat, in which case the heel rests on the upper horizontal edge 4 of the rib, or it may present a longitudinal notch so that this notch caps the groove.

In all the embodiments of the invention which have been described hereinabove, the interior of the ski may be left empty or it may be filled with an appropriate filling material. The upper longitudinal rib 2 of the ski has a width and/or height which is constant, as shown in the drawing, or variable along its length. It may be used not only for lateral guiding and centering of the shoe but also for mounting the binding holding the front end of the shoe.

Although it has been described, in the foregoing description, of the application of the invention to a cross-country ski, it goes without saying that the particular structure of the ski may be used for other types of ski, particularly for practising alpine skiing or long-run skiing.

We claim:

1. A ski, having a vertical longitudinal plane, comprising a longitudinal guidance rib having a top part, a sole, a front end part, a rear end part and a central area having a bearing portion to support and guide the sole of a shoe or boot, said central area including a first section and a second section superposed on said first section, said first section and second section each having the shape of a quadrilateral wherein the upper side of said first section and the lower side of said second section define a common imaginary line between said first section and said second section, lateral sides of said first section converging upwardly and being more inclined with respect to said vertical longitudinal plane than lateral sides of said second section, said central area including a front area extending between said bearing portion and said front end part and a rear area extending between said bearing portion and said rear end part, said front area and rear area each having the form of a single quadrilateral, said front end part and rear end part each including a flat upper surface, said front area, said rear area, and said bearing portion thereby joining the flat upper surface of said front end part and said rear end part.

2. The ski according to claim 1, wherein the lateral sides of said second section converge upwardly.

3. The ski according to claim 1, wherein the lateral sides of said second section are substantially vertical.

4. The ski according to claim 1, wherein said bearing portion has a length at least equal to the length of a shoe or boot.

5. The ski according to claim 1, wherein said rib comprises an outer shell which defines the profile of the ski along its entire length, and an inner core extending over the entire length of the ski, the height of said core being variable.

6. The ski according to claim 5, comprising a lower substantially horizontal reinforcing element fastened beneath said core, said sole of the ski being beneath said reinforcing element.

7. The ski according to claim 6, wherein said shell includes a substantially horizontal face, said core including a substantially horizontal upper wall fastened beneath said substantially horizontal face, at least one lower wall being fastened to said reinforcing element, and at least one substantially vertical wall extending between said upper wall and said at least one lower wall.

8. The ski according to claim 7, said core being omega-shaped in transverse section, said core including two substantially vertically walls extending downwardly from said upper wall, two lower walls respectively extending outwardly from lower ends of said two substantially vertical walls, said reinforcing element being fastened to said two lower walls.

9. The ski according to claim 7, said core being omega-shaped in transverse section, said core including two walls being inclined with respect to said vertical longitudinal plane and extending downwardly from said upper wall, two lower walls respectively extending outwardly from lower ends of said two inclined walls, said reinforcing element being fastened to said two lower walls.

10. The ski according to claim 7, said core being I-shaped in transverse section, said core including an upper flange, a lower flange, and a substantially vertical web connecting said upper flange and said lower flange, said upper flange being fastened to said substantially horizontal face, said lower flange being fastened to a central portion of said reinforcing element.

11. The ski according to claim 7, said core being in the shape of an inverted Y in transverse section, said core including an upper wall fastened to said substantially horizontal face, a substantially vertical web extending downwardly from said upper wall, two inclined lower branches extending downwardly and outwardly from said web, two flanges respectively extending from lower ends of each of said lower branches, said two flanges being fastened to said reinforcing element.

12. The ski according to claim 7, said core being omega-shaped in transverse section, said core comprising a first and second half-section being substantially symmetrical to each other with respect to said vertical longitudinal plane, said first and second half-section each being substantially Z-shaped and each comprising an upper substantially horizontal flange, a lower substantially horizontal flange, and a substantially vertical wall connecting said lower flange and said upper flange, the upper flanges of said first and second half-section being fastened to said substantially horizontal face, and said lower flanges each being fastened to said reinforcing element.

13. The ski according to claim 6, wherein said reinforcing element includes a projecting rib.

14. The ski according to claim 13, wherein said projecting rib is located in a central portion of said reinforcing element.

15. The ski according to claim 5, wherein the lateral sides of said first section each include a substantially vertical lower edge, said core including substantially vertical edges which are fastened to a respective said lower edge.

16. The ski according to claim 6, wherein the lateral sides of said first section each include a substantially vertical lower edge, each said lower edge being fastened to said reinforcing element.

17. The ski according to claim 15, wherein said core is substantially omega-shaped, and includes two lower substantially horizontal flanges which extend outwardly and terminate in said substantially vertical edges of said core.

18. The ski according to claim 17, each said substantially vertical edge of said core being fastened directly to a respective vertical edge of said first section.

19. The ski according to claim 17, wherein said reinforcing element includes upwardly extending edges, said edges of said reinforcing element being located between a respective said lower edge of said first section and a respective edge of said core.

20. The ski according to claim 19, wherein each said edge of said core includes an inverted U-shaped cap to cover a respective said edge of said reinforcing element.

21. The ski according to claim 6, wherein said lateral sides of said first section are directly connected to said reinforcing element.

22. The ski according to claim 1, wherein said first section has the form of a trapezium.

23. The ski according to claim 22, wherein said second section has the form of a rectangle.

24. The ski according to claim 23, wherein said rectangle is a square.

25. The ski according to claim 22, wherein said second section has the shape of a trapezoid.

26. The ski according to claim 25, wherein said first section and said second section each have the shape of an isosceles trapezoid.

27. The ski according to claim 26, wherein said lateral sides of said first section and said lateral sides of said second section are respectively symmetrical with respect to said vertical longitudinal plane.

28. The ski according to claim 27, wherein the angle of inclination of said lateral sides of said second section vary with respect to said vertical longitudinal plane from the front to the rear of said bearing portion.

29. The ski according to claim 28, wherein said angle of inclination is substantially within the range of 0 to 10 degrees at the front of said bearing portion and substantially within the range of 20 to 40 degrees at the rear of said bearing portion

30. The ski according to claim 29, wherein said angle of inclination at the front of said bearing portion is approximately 5 degrees.

31. The ski according to claim 28, wherein the angle of inclination of said lateral sides of said first section is substantially within the range of 30 to 60 degrees.

32. A ski having a vertical longitudinal plane, comprising a longitudinal rib having a top part, a sole, a front end part, a rear end part, and a central area having a bearing portion to support the sole of a shoe or boot, said central area including an outer shell including a first section and a second section superposed on said first section, said first and second section each having the shape of a quadrilateral wherein the upper side of said first section and the lower side of said second section define a common imaginary line between said first section and said second section, lateral sides of said first section converging upwardly and being more inclined with respect to said vertical longitudinal plane than lateral sides of said second section, an inner core extending along the length of the ski, a lower substantially horizontal reinforcing element fastened beneath said core, said sole of the ski being beneath said reinforcing element, said lateral sides of said first section each include a substantially vertical lower edge, said core comprising two lower substantially horizontal flanges which extend outwardly and terminate in substantially vertical edges, said reinforcing element including upwardly extending edges, said edges of said reinforcing element being located between and fastened to a respective said lower edge of said first section and a respective edge of said core.

33. The ski according to claim 32, wherein each said edge of said core includes an inverted U-shaped cap to cover a respective said edge of said reinforcing element.

* * * * *

UNITED STATES PATENT AND TRADEMARK OFFICE

CERTIFICATE OF CORRECTION

PATENT NO. : 4,957,304

DATED : September 18, 1990

INVENTOR(S) : Jean-Luc DIARD et al.

It is certified that error appears in the above-identified patent and that said Letters Patent is hereby corrected as shown below:

On title page, item [56], Foreign Patent Documents change "Australia" to ---Austria---.

At column 4, line 37, of the printed patent, change "13a" (both occurrences) to ---3a---.

Signed and Sealed this

Ninth Day of March, 1993

*Attest:*

STEPHEN G. KUNIN

*Attesting Officer*

*Acting Commissioner of Patents and Trademarks*